US005405252A

United States Patent [19]

Nikkanen

[11] Patent Number: 5,405,252

[45] Date of Patent: Apr. 11, 1995

[54] METERING PUMP

[76] Inventor: Erik Nikkanen, 124 Sandyhook Square, Scarborough, Ontario M1W 3N5, Canada

[21] Appl. No.: 238,158

[22] Filed: May 4, 1994

Related U.S. Application Data

[63] Continuation-in-part of Ser. No. 964, Jan. 6, 1993, abandoned.

[51] Int. Cl.[6] ..... F04B 43/08

[52] U.S. Cl. ..... 417/478; 417/479; 101/363; 101/350

[58] Field of Search ..... 417/474, 478, 479, 480; 101/363, 364, 352

[56] References Cited

U.S. PATENT DOCUMENTS

| | | | |
|---|---|---|---|
| 2,393,838 | 1/1946 | Tarbox | 417/474 |
| 3,606,596 | 9/1971 | Edwards | 417/478 X |
| 3,658,445 | 4/1972 | Perlman et al. | 417/474 |
| 4,236,881 | 12/1980 | Pfleger | 417/510 X |
| 4,479,761 | 10/1984 | Bilstad et al. | 417/477 X |
| 4,657,490 | 4/1987 | Abbott | 417/478 |
| 4,846,635 | 2/1989 | Danby et al. | 417/479 X |
| 5,042,381 | 8/1991 | Thompson et al. | 101/350 X |
| 5,158,437 | 10/1992 | Natwick et al. | 417/479 X |
| 5,252,044 | 10/1993 | Raines | 417/479 |
| 5,289,772 | 3/1994 | Kohara et al. | 101/363 X |

*Primary Examiner*—Richard E. Gluck
*Attorney, Agent, or Firm*—Ladas & Parry

[57] ABSTRACT

A metering pump for use on a printing press has a pumping chamber formed between a rigid support plate and a flexible diaphragm. A piston acts through the diaphragm to vary the volume of the chamber and flow to and from the chamber is controlled by respective valves. The valves are formed by co-operation between the diaphragm and support plate and are operated by pistons acting through the diaphragm.

23 Claims, 10 Drawing Sheets

METERING PUMP

This application is a continuation-in-part application of application Ser. No. 08/000,964 filed Jan. 6, 1993, now abandoned.

This application relates to metering pumps and in particular to metering pumps that are suitable for use with the fountain of a printing machine.

Metering pumps are used to control the flow of fluid from a reservoir to an outlet. A typical application for such pumps is in the fountain of a printing press where the pumps have been used in an attempt to regulate the amount of ink deposited onto the roller of a printing press. Conventional presses utilize a metering blade but with such a system it is very difficult to tell how much ink has been put onto a roller. By utilizing a metering pump, it is possible to know how much ink has been deposited on the roller and to control the flow rate of ink as the operating conditions of the printing press vary.

The pumps shown in the prior art for use with printing presses have utilized reciprocating components in contact with the ink for metering. These arrangements, however, make cleaning of the apparatus very difficult, as essentially the pumps have to be disassembled for adequate cleaning. Failure to do this may result in contamination of an ink subsequently used on the same press. A further problem is that the inks tend to be very abrasive and therefore their contact with reciprocating parts of the pump causes rapid wear and frequent replacement.

The inks conventionally used with offset printing processes tend to be less fluid and cannot be delivered satisfactorily with conventional reciprocating piston pumps. The vapour pressure of these less fluid inks is relatively low and can be easily attained on the suction side of conventional pumps. Moreover, the work imparted to the ink during passage through the pumps can cause cross-polymerization within certain inks so that their performance during the printing process is not that anticipated. Accordingly, the use of metering pumps has not been widely adopted with printing presses.

It is therefore an object of the present invention to provide a metering pump suitable for use in a printing press in which the above disadvantages are obviated or mitigated.

In general terms, the present invention provides a metering pump in which a pumping chamber is formed between a flexible diaphragm and a rigid support plate. A pumping element acts upon the diaphragm on the opposite side thereof to the support plate to vary the volume of the chamber. Flow through the chamber is controlled by inlet and outlet valves and the drive is provided to operate the pumping element to induce fluid into the chamber and expel it from the chamber.

The diaphragm prevents contact of the ink with the pumping elements and in a preferred embodiment presents a planar surface in contact with the ink that facilitates cleaning once the support plate has been removed.

An embodiment of the invention will now be described by way of example only with reference to the accompanying drawings, in which FIG. 1 is an end view of a printing press with a metering pump installed and part of the pump shown in section;

Figure 3:
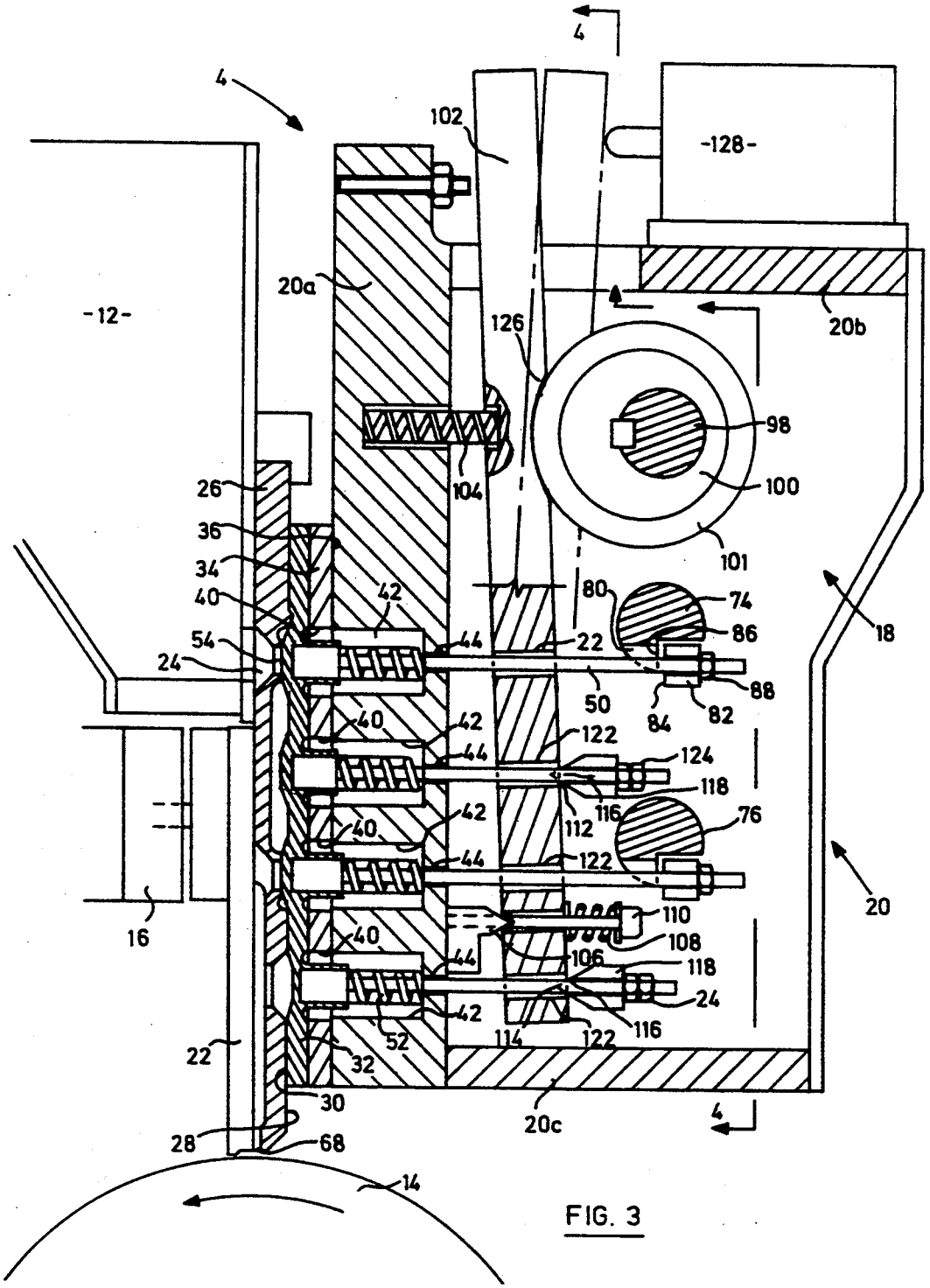
FIG. 3 is a section on the line 3—3 of FIG. 1.
Figure 4A:
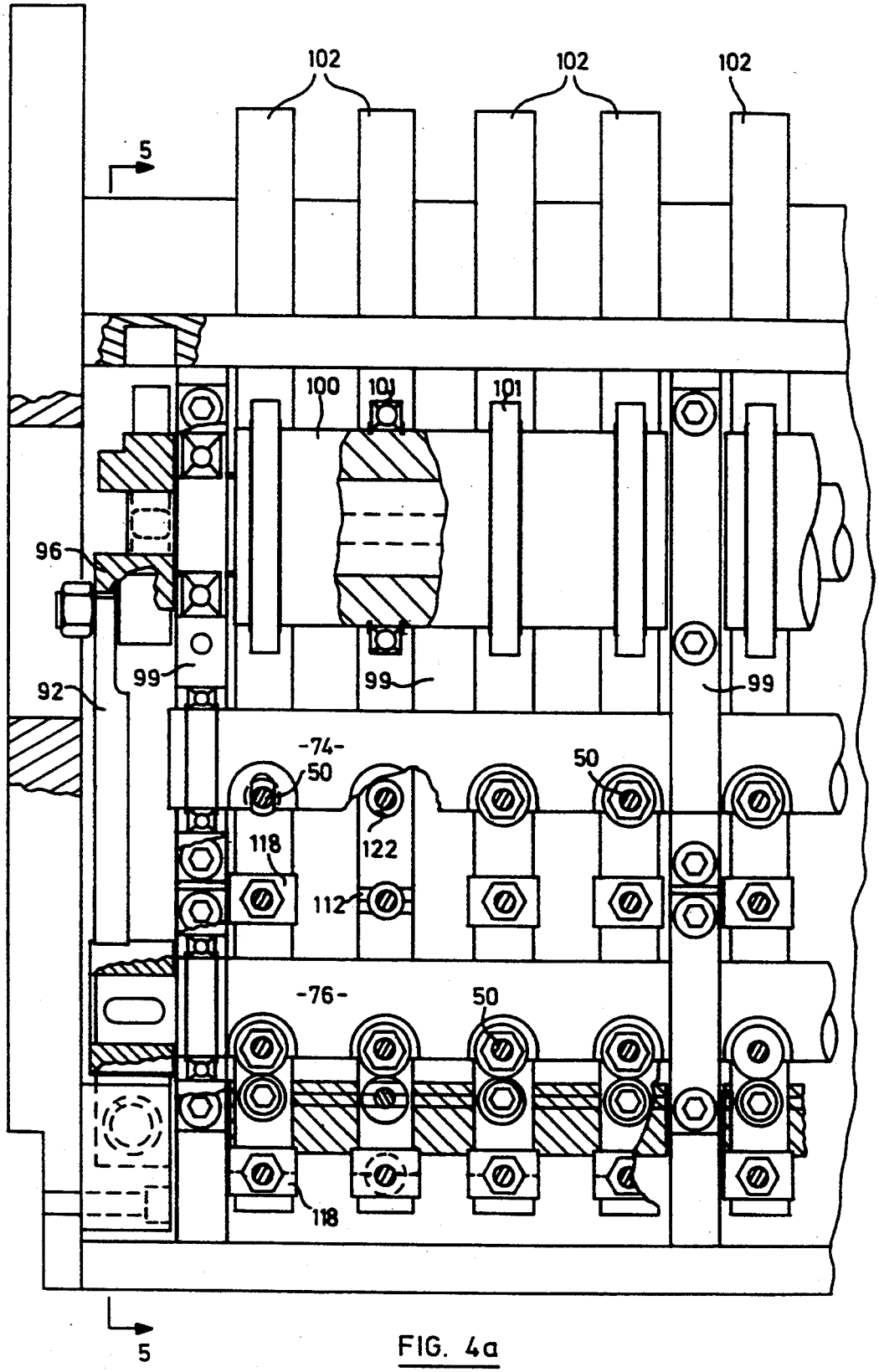
Figure 4B:
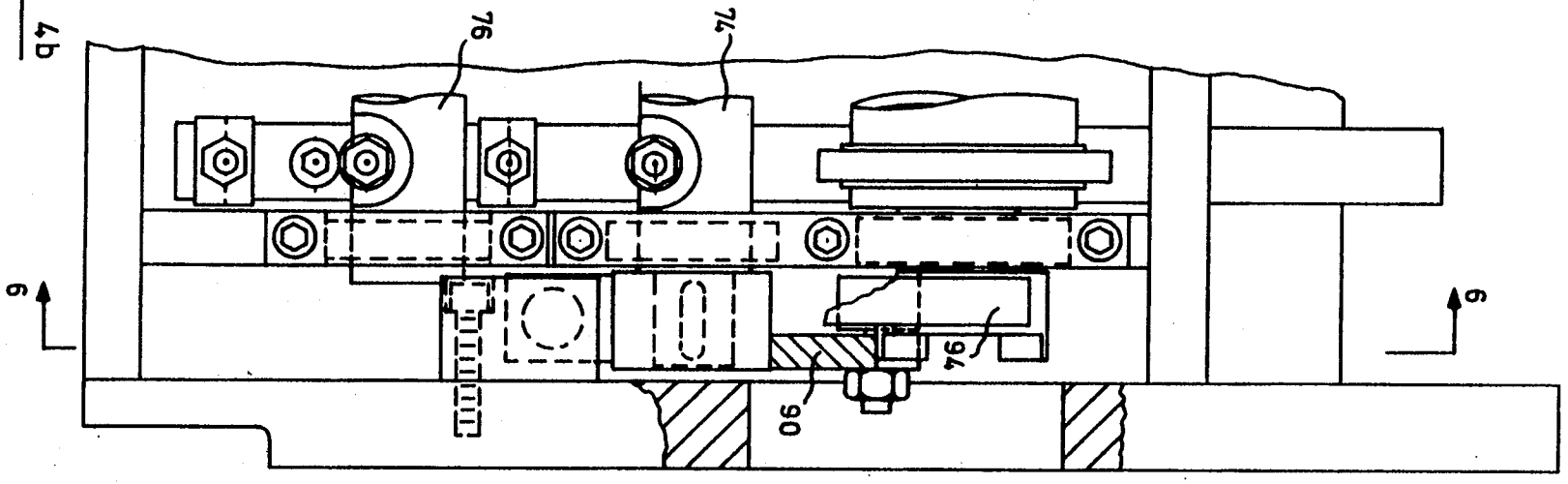
Figure 5:
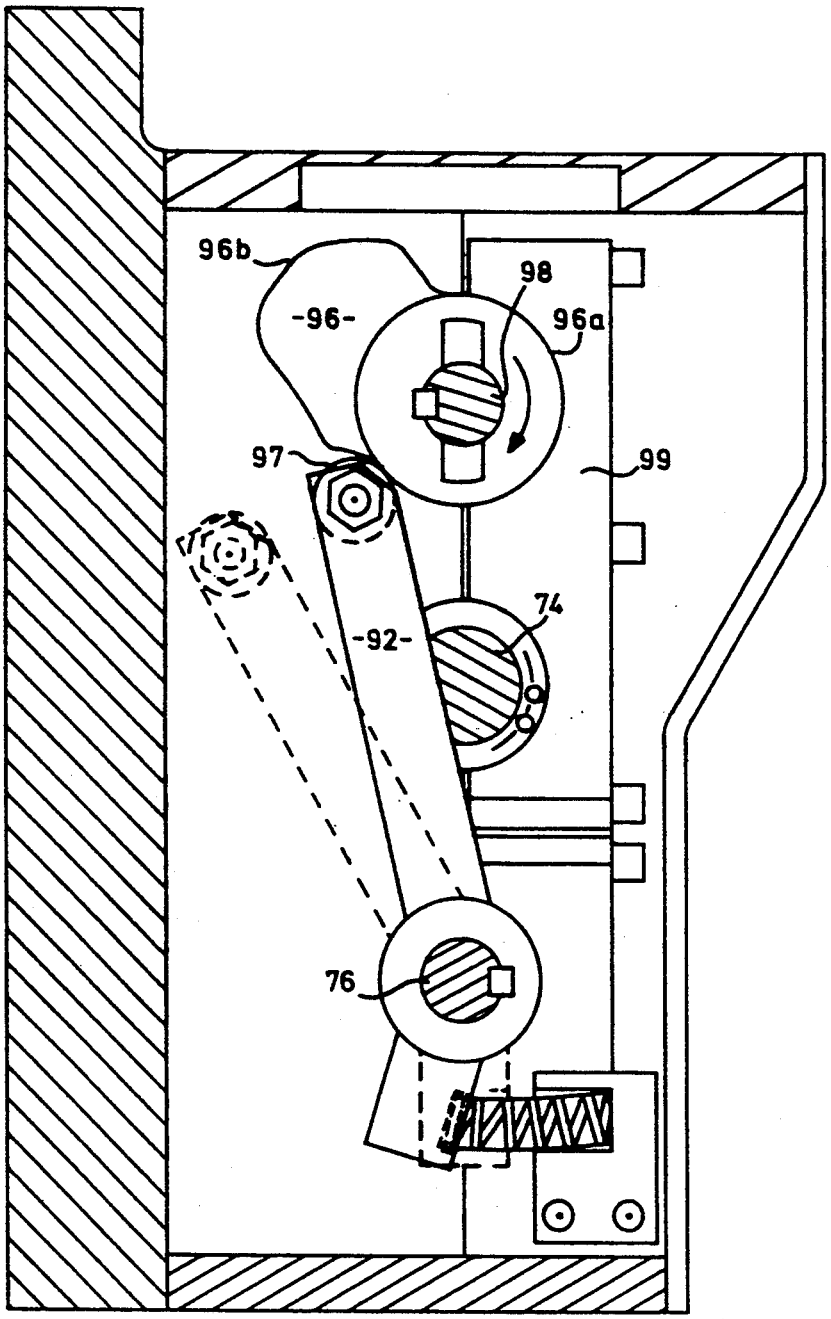

FIGS. 4*a* and 4*b* are views on the line 4—4 of FIG. 3, with FIG. 4*a* showing one end of the printing press and FIG. 4*b* showing the opposite end;

FIG. 5 is a view on the line 5—5 of FIG. 4*a;*

Figure 6:
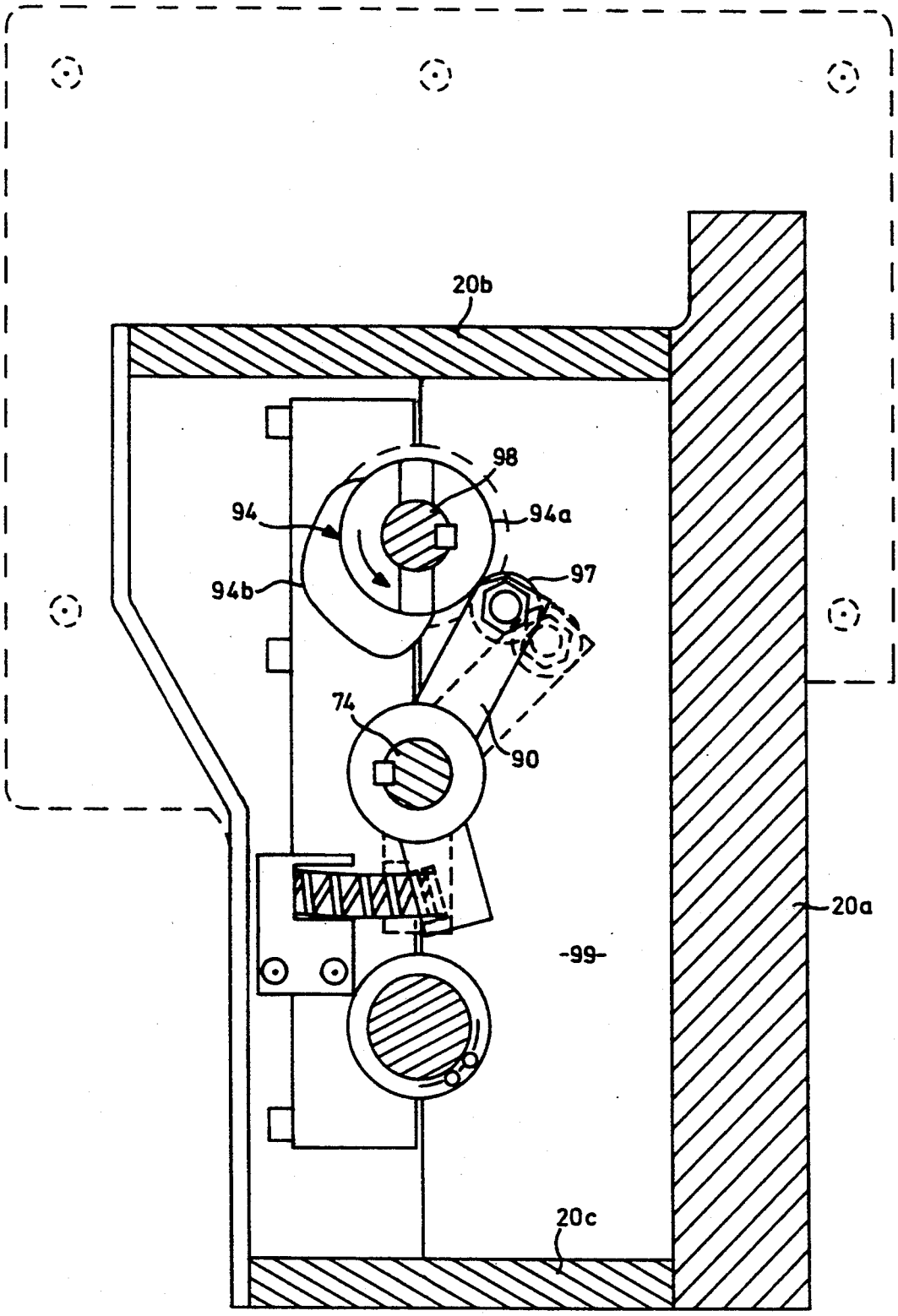

FIG. 6 is a view on the line 6—6 of FIG. 4*b;*

Figure 1:
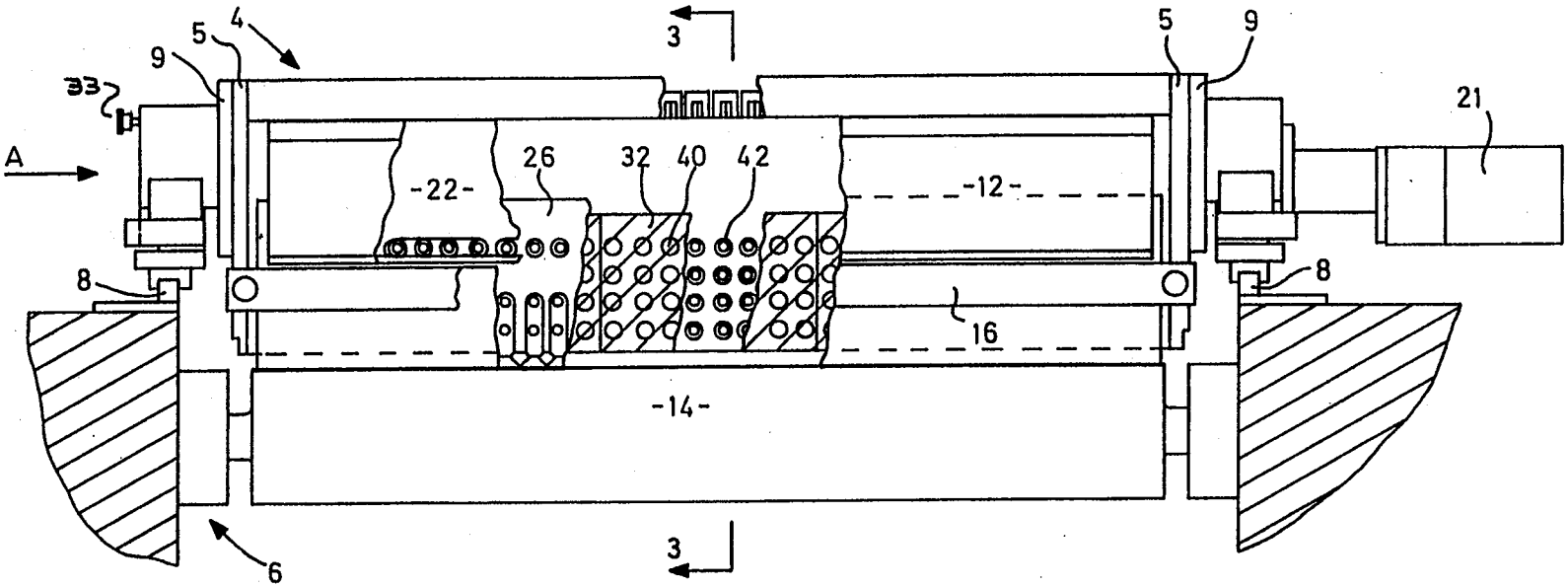
Figure 7:
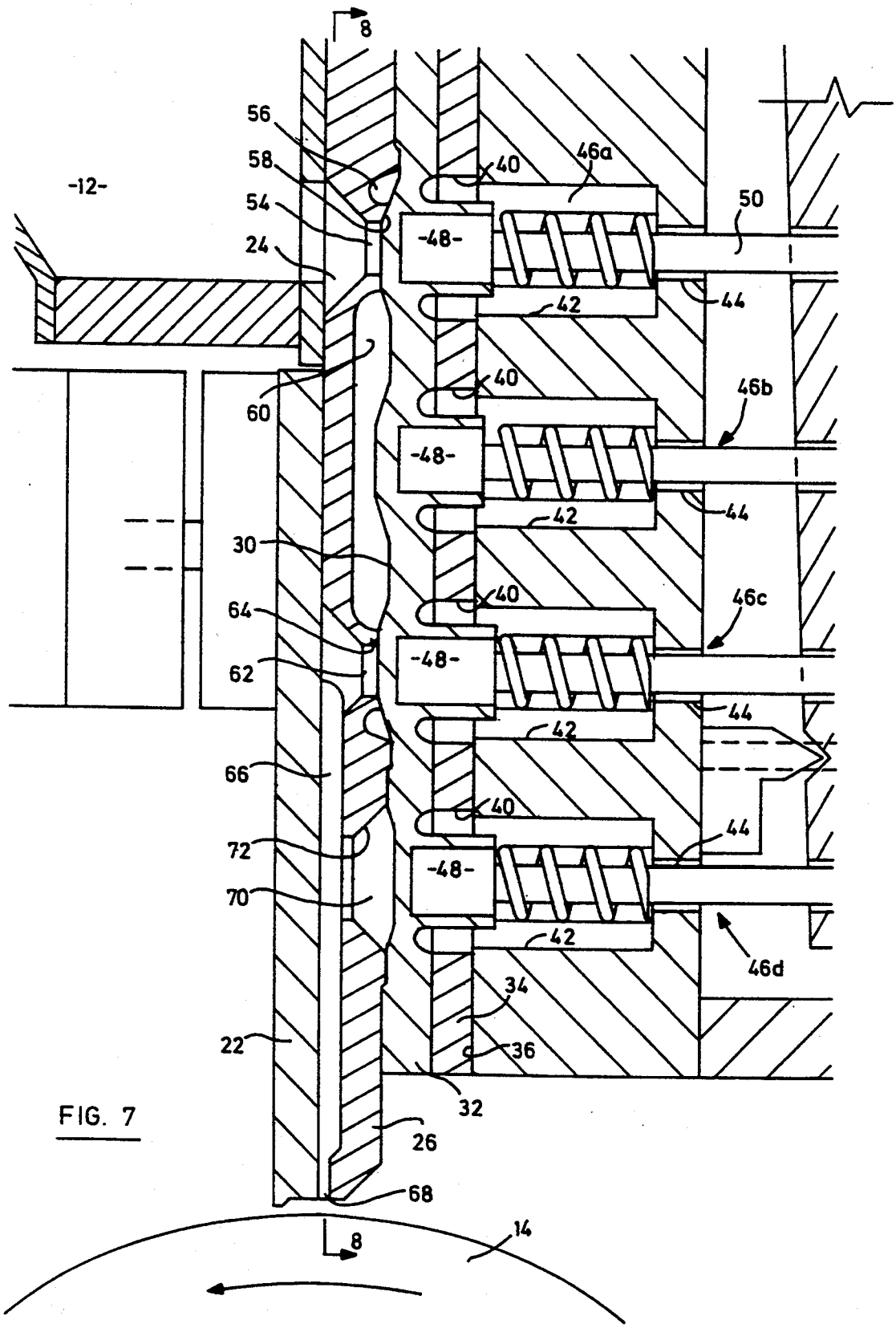
Figure 8:
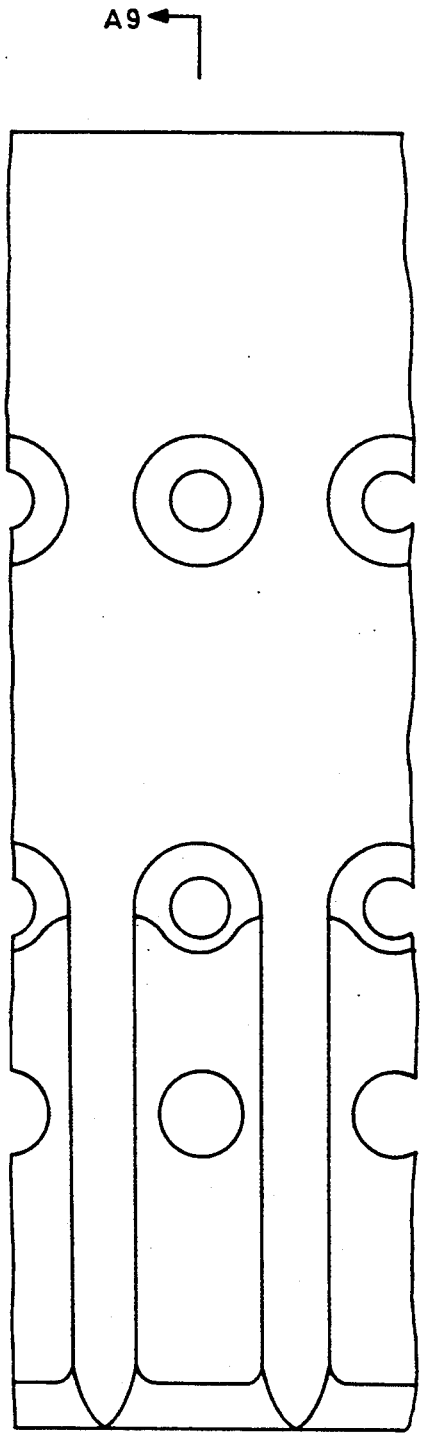
Figure 9:
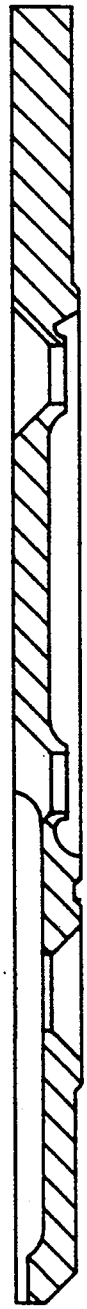
Figure 10:
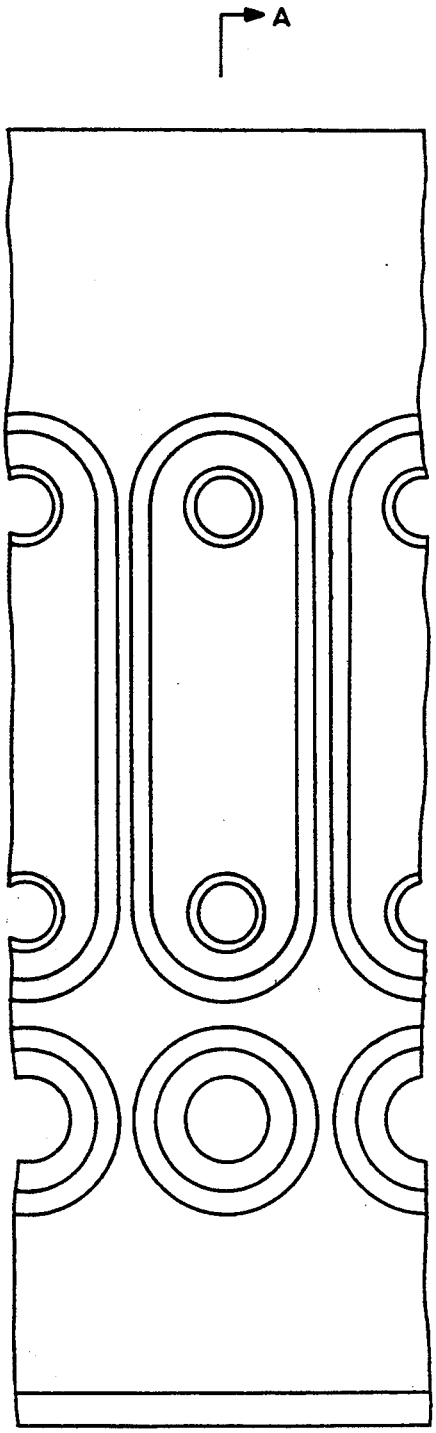
Figure 11:
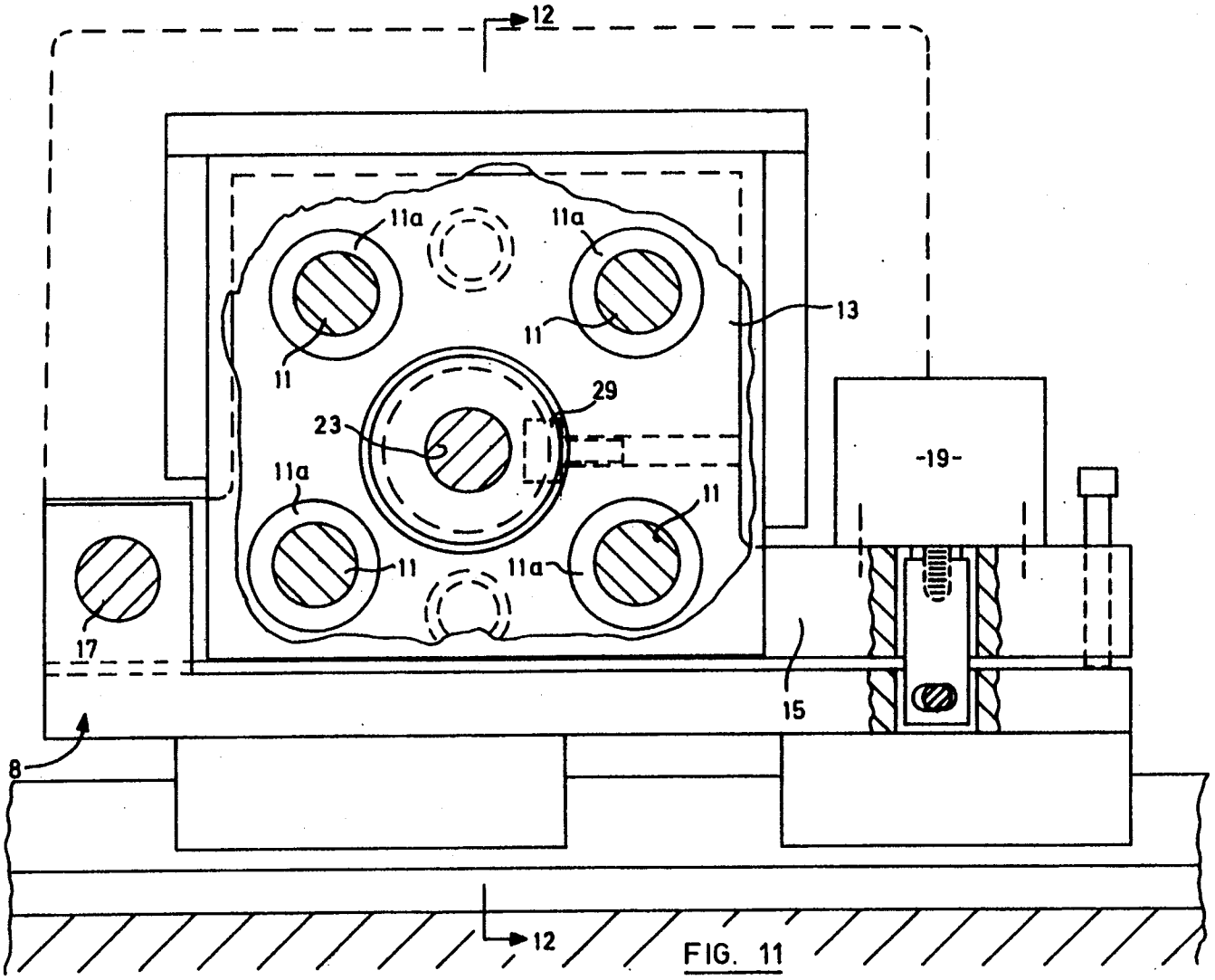
Figure 12:
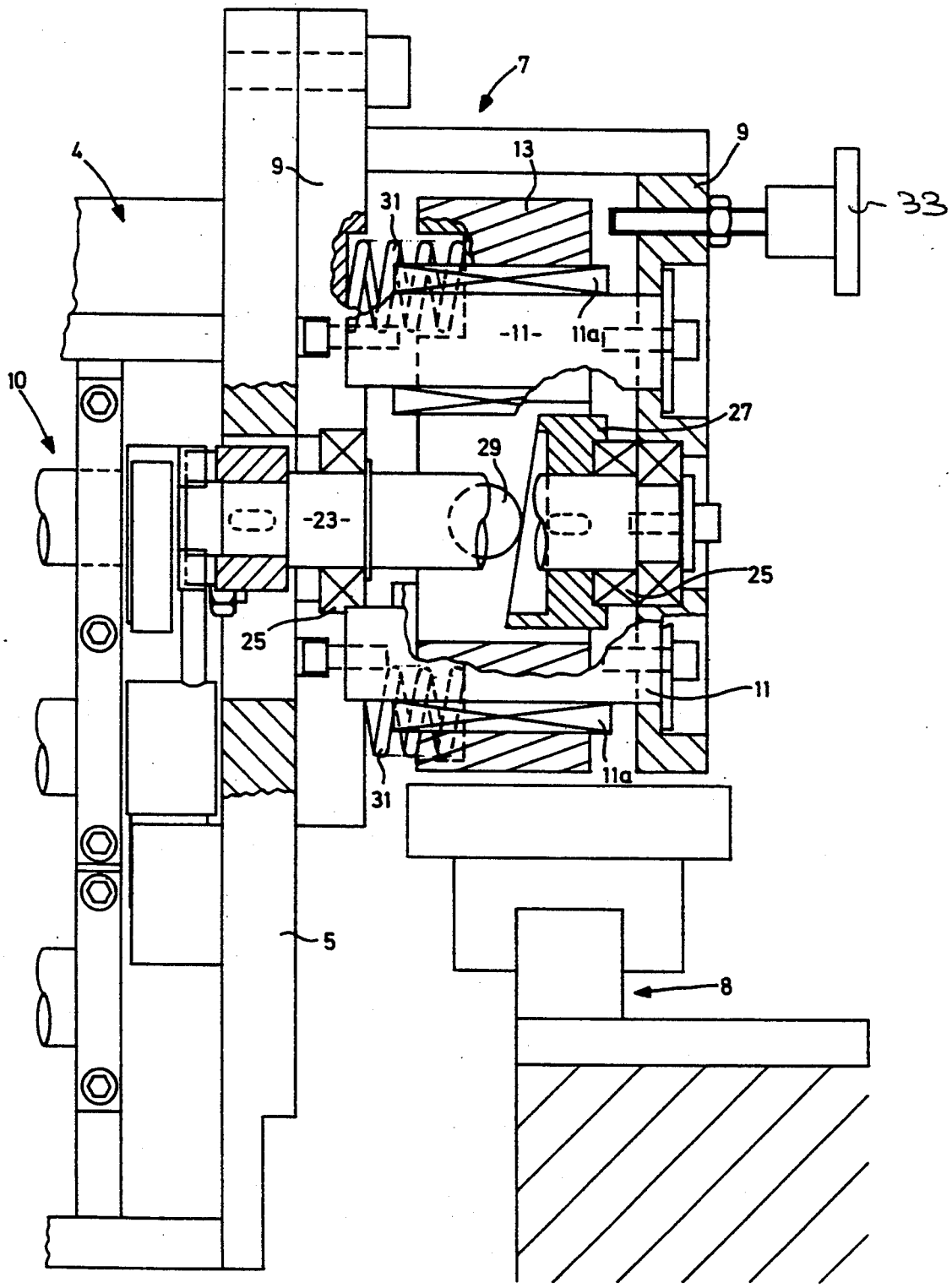

FIG. 7 is a view on an enlarged scale of a portion of the press shown in FIG. 3;

FIG. 8 is a view on the line 8—8 of FIG. 7;

FIG. 9 is a view on the line 9—9 of FIG. 8;

FIG. 10 is a view in the direction of arrow 10 of FIG. 9;

FIG. 11 is an end view in the direction of arrow A, partly in section and on an enlarged scale, of the press shown in FIG. 1; and FIG. 12 is a view on the line 12—12 of FIG. 11.

Referring therefore to the drawings, a fountain generally indicated at 4 is mounted on a press 6 to extend transversely across the press between support rails 8. The fountain 4 transfers ink from a reservoir 12 to a slow speed roller 14 which, in turn, transfers ink in a conventional manner to the high speed roller associated with the printing press 6. In some cases where highly viscous inks are used, a distributing roller may be incorporated in the reservoir to provide a positive pressure at the outlet of the reservoir to improve the flow of ink to the fountain 4. The fountain 4 and reservoir 12 are supported on rails 8 for oscillatory motion as best seen in FIGS. 11 and 12.

The fountain 4 includes end plates 5 at each end to each of which is bolted a drive housing 7. Each of the drive housings 7 has a pair of laterally spaced side plates 9 which support guide pins 11 slidably received in linear bearings 11*a* located in an extension 13 of a mounting arm 15. The mounting arm 15 is pivoted to the side rails 8 by a pin 17 and supported at its forward end on a hydraulic leveller 19.

A drive shaft assembly 10 extends across the fountain from a motor 21 at one side of the fountain 4 and, at the opposite end, includes a stub shaft 23 that is supported in bearings 25. The stub shaft carries a cam 27 that engages a follower 29 supported in the extension 13. Thus as the shaft assembly 10 rotates,the housing 7 is displaced laterally relative to the extension 13 to oscillate the fountain 4 relative to the press 6. A spring 31 acts between the side plate 9 and extension 13 to maintain the follower 29 against the cam 27. An adjustable stop 33 limits oscillatory motion to a desired range.

Figure 2:
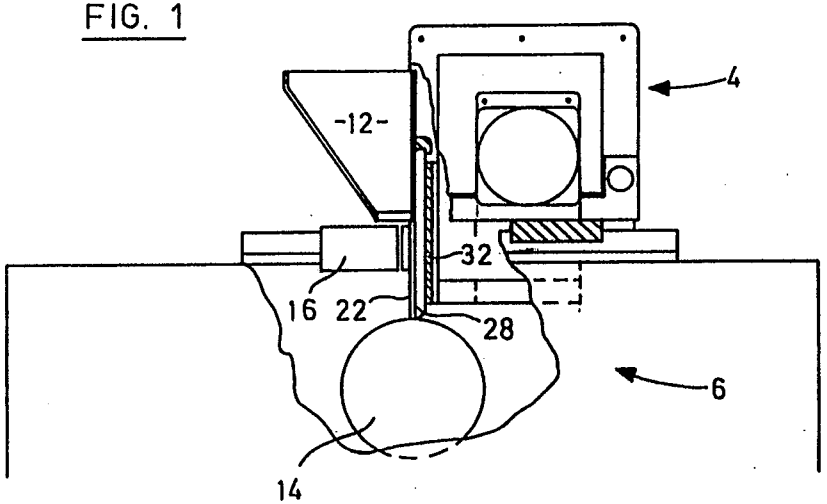
FIG. 2 is a side view of the press shown in FIG. 1 partly in section.

As can best be seen in FIG. 3, the fountain 4 includes a metering pump 18 that is supported by a pump housing 20. The housing includes a front plate 20*a*, and top and bottom plates 20*b,c* respectively that extend between the side plates 5. The pump 18 consists of a number of stations uniformly spaced across the roller 14 and operating in synchronism to deliver fluid from the reservoir to the roller 14. The pump 18 is clamped to the frame 20 by a clamping beam 16 which applies uniform pressure across the width of the press by means of fluid cylinders or mechanical clamps. The clamps 16 may act directly on the support plate 22 as shown in FIGS. 2 and 3 or, alternatively, may be located remotely on the opposite side of the fountain and act through extensions onto the support plate. This latter option permits increased visibility of the transfer roller 14 by the operator. The details of each station of the pump 18 are shown in detail in FIGS. 3, 4 and 7.

Referring therefore to FIG. 3, at each station of the pump 18, a backing plate 22 is interposed between clamping beam 16 and a support plate 26 which has an inlet duct 24 aligned with the outlet from the reservoir 12. The support plate 26 extends upwardly beyond the backing plate 22 to provide support for the reservoir 12 and has an outer surface 28 in abutment with a planar surface 30 on a diaphragm 32. The diaphragm 32 itself is bonded to an apertured mounting plate 34 which is held against a vertical face 36 of the front plate **20*a* of frame 20**.

As shown in FIGS. 1 and 3, the mounting plate 34 is provided with an array of apertures 40 arranged in columns corresponding to each station at uniform spacing across the width of the fountain 4. Each of the apertures 40 is aligned with a counterbore 42 formed in the vertical face 36 and extending to a reduced diameter hole 44 passing through the frame 20.

Referring in particular to FIGS. 3 and 7, each of the counterbores 42 accommodates a piston assembly, generally indicated at 46, having a piston 48 received within the aperture 40 in the mounting plate 34 and a piston rod 50 extending through the hole 44. The piston 48 is bonded to the diaphragm 32 and a spring 52 acts between the piston 48 and the counterbore 42 to bias the piston assembly 46 to move the diaphragm 32 toward the support plate 26.

The support plate 26 is formed with fluid passages to allow fluid in the reservoir 12 to flow onto the surface of the roller 14. At each station, an inlet port 54 extends from the inlet duct 24 to a recess 56 on the outer surface 28. A land 58 extends around the port 54 and communicates with an elongate slot 60 extending vertically between the surfaces 28, 30 of the support plate 26 and diaphragm 32 respectively. At the lower end of the slot 60, an outlet port 62 is formed and is surrounded by an upstanding land 64 that is spaced above the base of slot 60 but also from the surface 30 of the diaphragm 32.

The port 62 communicates with an elongate channel 66 formed on the opposite side of support plate 26 and terminating in a nozzle 68 adjacent the surface of the roller 14. A secondary chamber 70 is formed in the support plate 26 between the outlet port 62 and the nozzle 68. The chamber 70 is formed with conical flanks 72 to facilitate cleaning and provide progressive entry into the chamber 70.

It will be noted from FIGS. 3 and 7 that the inlet port 54 is aligned with a first of the piston assemblies indicated at **46*a* and that the outlet port 62 in the support plate 26 is aligned with another of the piston assemblies indicated at 46*c*. The piston assembly 46*b* located between assemblies 46*a* and 46*c* is located midway along the slot 60 and piston assembly 46*d* is aligned with the chamber 70**.

The piston assemblies **46*a* and 46*c* act as valve operators whose movement is controlled by means of an oscillating drive rods 74, 76 respectively. The drive members 74, 76 extend between sideplates 5 of the frame 20 and can rotate about their axes relative to the sideplates. The drive rods 74, 76 are provided with notches 80 to receive the piston rods 50. A stop 82 is threaded onto the end of the piston rod 50 and has an abutment surface 84 that engages a step 86 in the notch 80. A locknut 88 is also threaded onto the piston rod 50 so that the position of the stop 82 on the piston rod 50** can be secured.

Each of the drive rods 74, 76 has a respective operating lever 90, 92 (FIG. 4) secured at opposite ends of the housing 20 with the levers 90, 92 bearing against respective cam members 94,96 through rollers 97. The cams 94,96 are mounted on opposite ends of drive shaft 98 that forms part of driveshaft assembly 10 and is rotatable about its axis by drive motor 21. Each of the cams 94, 96 include a dwell portion, designated "a" and a lift portion, designated "b", to displace the respective one of the levers 90,92 as the drive shaft 98 rotates.

The drive shaft 98 is supported at spaced locations on vertical webs 99 which extend between top and bottom plates **20*b*,20*c*. An eccentric bush 100 is keyed to the shaft 98 between each pair of webs 99 and carries a roller assembly 101 at each of the pump stations to provide a cam that bears against an actuating lever 102. Each of the actuating levers 102 is biased against the roller assembly 101 by a spring 104 and is pivotally mounted on a fulcrum 106 located approximately two thirds of the distance between the piston assemblies 46*b* and 46*d*. The lever 102 is retained against the fulcrum 106 by means of a spring 108 acting between the lever 102 and a retaining pin 110**.

The piston rods 50 of the piston assemblies 46 pass through bores 122 located at spaced locations along the lever 102. Each of the levers 102 has a pair of notches 112,114 on the opposite side to the fulcrum 106 and aligned with the piston assemblies **46*b* and 46*d* respectively. The notches 112,114 receive the apex 116 of an adjustable stop 118 that is slidably mounted on to the piston rod 50 and secured with a locknut 124**.

The upper end of actuating lever 102 extends past the drive shaft 98 and is engageable with an adjustable abutment 128. The abutment 128 limits movement of the lever 102 under the influence of the spring 104 causing it to leave the surface of the roller assembly 101 over a portion of the rotation of the drive shaft 98. An arcuate recess 126 is formed in the lever 102 and corresponds to the maximum radius of the roller assembly 101 relative to the axis of rotation of the drive shaft 98 to provide an extended dwell period at maximum eccentricity.

In operation, rotation of the driveshaft 98 will induce oscillatory pivotal motion of the actuating levers 102 about the fulcrum 106. As each of the levers 102 oscillates, it causes reciprocation of the respective piston assemblies **46*b* and 46*d* in opposite directions. Because of the location of the fulcrum 106 relative to the piston assemblies 46*b* and 46*d*, the stroke of the piston assembly 46*c* is approximately twice that of the piston assembly 46*d***.

Rotation of the driveshaft 98 also causes oscillatory motion of the operating levers 90,92 to cause oscillatory rotation of the drive rods 74,76. The oscillatory motion is controlled by the profile of the cams 94,96 so that the piston assemblies **46*a* and 46*c* are caused to reciprocate toward and away from the surface 28 at different times during rotation of the shaft 98**.

With the shaft 74 rotated fully clockwise, that is with the lever 90 on the dwell **94*a* of the cam 94, the piston assembly 46*a* acts through the diaphragm 32 under the influence of spring 52 to seal the inlet port 54. The face 30 of the diaphragm 32 seats against the land 58 and thereby prevents flow of fluid through the inlet duct 24 from reservoir 12. As the cam 94 rotates, it causes the drive rod 74 to rotate counter clockwise to move the piston assembly 46*a* against the bias of spring 52 and thereby pulls the diaphragm 32 away from the land 58. In this position, the inlet port 54 is opened and ink can flow into the slot 60. Continued rotation of the cam 96 allows the piston assembly 46*a* to be returned under the influence of the spring 52 to once again seal the inlet. As can be seen from the foregoing, the land 58 of the inlet port 54 coacts with the diaphragm 32** so as to define an inlet valve.

During retraction of the piston assembly 46*a*, the lever 102 follows the roller 101 under the action of spring 104 to withdraw the piston 46*b* against the action of the spring 52. The volume of the chamber formed by the slot 60 and the diaphragm 32 is thus increased up to a maximum determined by the abutment 128.

During the time that the port 54 is open, the lever 92 is on the dwell portion 96*b* of cam 96 so that the piston assembly 46*c* forces the face 30 of diaphragm 32 against the land 64 to seal the outlet port 62 and prevent fluid from flowing between slot 60 and the channel 66. However, the actuating lever 102 permits the spring 52 associated with the piston assembly 46*d* to deflect the diaphragm 32 into the chamber 70 and reduce its volume, causing fluid to flow from the chamber 70 through the nozzle 68 and onto the roller 14.

Continued rotation of the drive shaft 98 causes the drive rod 76 to retract the piston assembly 46*c* and open the outlet port 62. The actuating lever 102 is moved in a direction to allow the piston assembly 46*b* to deflect the diaphragm 32*b* into the slot 60 and so expel fluid through the outlet port 62. The chamber 70, however, is increasing in volume as the piston assembly 46*d* is retracted by the lever 102 so that fluid expelled by the piston assembly 46*b* is partially absorbed by the increased volume in the chamber 70. Because of the differing strokes between the piston assemblies 46*b* and 46*d*, a net flow is available to flow out of the nozzle and onto the roller 14. The foregoing demonstrates that the land 64 of outlet port 62 coacts with the diaphragm 32 so as to define an outlet valve.

The relative timing between movement of the piston assemblies 46*b* and 46*d* and their different strokes permits the piston assembly 46*d* to even the flow through the nozzle 68 due to the pumping stroke of the piston assembly 46*b* and thereby permit a more uniform flow.

The average flow rate from pump 18 is determined by the speed of rotation of the shaft 98 and hence is adjusted by increasing the speed of the drive motor 21. The profile of the ink flow onto the roller 14 may be varied by adjusting the abutment 128 at each station to increase or decrease the stroke of the piston assemblies 46*b* and 46*d* respectively. However, this adjustment will not affect the opening and closing of the ports 54, 62 as their drive is taken through the levers 90, 92 and is not affected by the adjustment of the movement of the actuating lever 102. The flow rate at each station may thus be adjusted individually.

It will be seen that in operation, therefore, the pump 18 acts to transfer positively fluid from the reservoir 12 to the nozzle 68. In so doing, the piston assemblies 46 do not come into contact with the fluid and therefore will not be abraded or contaminated by them. In its free body state the outer surface 30 of the diaphragm 32 is planar and therefore makes cleaning of the diaphragm relatively simple. The backing plate and support plate 22, 26 may be removed and cleaned with a suitable solvent. The planar surface 30 of diaphragm 32 is then available for cleaning with a similar solvent, allowing rapid and effective cleaning and commissioning of the apparatus.

During rotation of the drive shaft assembly 10, the fountain 4 is bodily oscillated by the cam to smooth out irregularities that may occur between adjacent pump stations across the roller 14. It will be seen therefore that the metering pump 18 provides a simple but versatile device that facilitates the flow of ink onto the press roll without performing excessive work on the inks. At the same time, adjustment of the average flow rate may be accomplished by increasing the rotational speed of the drive shaft 98 which will not affect the individual metering action at each station of the pump. Individual flow rates for each station can also be adjusted without affecting adjacent stations.

I claim:

1. A fountain for application of a liquid to a web, having a plurality of metering pumps disposed in spaced relationship across said web, to pump liquid from a reservoir to a transfer roller, each of said metering pumps comprising:

an outlet for delivering said liquid to said transfer roller;

a rigid support plate removably secured in position:

a flexible diaphragm, said diaphragm and said support plate having opposed liquid contacting faces in abutment along a path extending from said reservoir to said outlet and defining a pump chamber between said liquid contacting faces;

a pumping element located on the opposite side of said diaphragm to said support plate, said pumping element being reciprocable relative to said support plate to vary the volume of said chamber, and being connected to said diaphragm to deflect said liquid contacting face of said diaphragm upon movement of said element away from said liquid contacting face of said support plate;

an inlet valve to control flow of liquid from said reservoir into said chamber and into contact with said faces;

an outlet valve to control flow between said chamber and said outlet, said inlet and outlet valves each being defined by said support plate and said diaphragm and each having a valve operating member associated therewith to regulate flow through said valves, each of said valve operating members acting through said diaphragm to engage said diaphragm with said support plate and thereby regulate flow through said valve; and drive means operable upon said pumping element to cause reciprocation thereof and alternately increase and decrease the volume of said chamber and upon said valve operating members to regulate flow to and from said chamber, said support plate being separable from said diaphragm to expose said liquid contacting face of said diaphragm to facilitate cleaning thereof.

2. A fountain according to claim 1 wherein each of said operating members is biased in a direction to close respective ones of said valves and valve drive means are provided to move said operating members against said biasing means and open said valves.

3. A fountain according to claim 2 wherein said abutting face of said diaphragm is planar and said abutting face of said support plate has formations formed therein to define said chamber and said valves.

4. A fountain according to claim 3 wherein each of said valves is defined by a peripheral land extending around a port and said valve operating member is operable to deform said diaphragm to engage said peripheral land and thereby inhibit flow through said valve.

5. A fountain according to claim 4 wherein each of said valve operating members is biased in a direction to deform said diaphragm and close said valves.

6. A fountain according to claim 5 wherein each of said valve operating members is a piston that is reciprocable in a direction normal to the abutting face and drive means are associated therewith to cause reciprocation thereof.

7. A fountain according to claim 1 wherein each of said pumps includes a secondary chamber defined between said diaphragm and said support plate and located between said outlet valve and said outlet.

8. A fountain according to claim 7 wherein an actuator operates upon said diaphragm on the opposite side thereof to said support plate to vary the volume of said secondary chamber.

9. A fountain according to claim 8 wherein said actuator is operated by a drive to vary cyclically the volume of said secondary chamber.

10. A fountain according to claim 9 wherein said drive means and said drive are interconnected to increase the volume of said secondary chamber as the volume of said pump chamber is decreased and to decrease the volume of said secondary chamber as the volume of said pump chamber is increased.

11. A fountain according to claim 10 wherein said valve operating member associated with said outlet valve is operable to close said outlet valve as the volume of said secondary chamber decreases and to open said outlet valve as the volume of said pump chamber decreases.

12. A fountain according to claim 11 wherein said inlet valve is defined between said diaphragm and said support plate and a valve operating member is associated therewith to open said valve as the volume of said pump chamber increases and close said inlet valve as the volume of said pump chamber decreases.

13. A fountain according to claim 10 wherein said pumping element and actuator are each reciprocable in a direction normal to said diaphragm to vary the volume of the respective ones of said chambers.

14. A fountain according to claim 13 wherein a link extends between said drive means and said drive, said link being supported intermediate said drive means and drive by a pivot for movement about an axis orthogonal to the direction of movement of said pumping element, whereby rotation of said link about said pivot moves said pumping element and actuator in opposite directions.

15. A fountain according to claim 14 wherein movement of said link about said pivot is controlled by a cam.

16. A fountain according to claim 10 wherein said actuator is connected to said diaphragm to deflect said diaphragm upon movement of said actuator.

17. A fountain according to claim 1 wherein a common valve drive means operates on said valve operating members for each of said metering pumps.

18. A fountain according to claim 17 wherein adjustment is provided between each of said operating members and said drive means to permit relative adjustment between adjacent pumps.

19. A fountain according to claim 14 wherein said links of each of said metering pumps are rotated conjointly by a cam shaft extending parallel to the rotational axis of said transfer roller.

20. A fountain according to claim 19 wherein adjustment is provided between said cam shaft and said drive means and said drive at each of said metering pumps to permit individual adjustment of said pumps.

21. A fountain according to claim 19 wherein each of said links includes a concave follower having a radius of curvature corresponding to the maximum radius of said cam to provide an extended dwell period during rotation of said cam.

22. A fountain according to claim 1 wherein said pumps are mounted on a frame and a drive member oscillates said frame in a direction transverse to said web.

23. A fountain according to claim 22 wherein said drive member includes a cam member rotatably associated with said drive means to oscillate said frame in unison with operation of said pumps.

* * * * *